US010315441B2

(12) United States Patent
Matsumoto

(10) Patent No.: US 10,315,441 B2
(45) Date of Patent: Jun. 11, 2019

(54) RECORDING APPARATUS

(71) Applicant: CANON KABUSHIKI KAISHA, Tokyo (JP)

(72) Inventor: Toshiya Matsumoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/661,656

(22) Filed: Jul. 27, 2017

(65) Prior Publication Data

US 2018/0029386 A1 Feb. 1, 2018

(30) Foreign Application Priority Data

Jul. 29, 2016 (JP) ..... 2016-150117

(51) Int. Cl.
*B41J 11/58* (2006.01)
*B41J 3/407* (2006.01)

(52) U.S. Cl.
CPC ..... *B41J 11/58* (2013.01); *B41J 3/4071* (2013.01)

(58) Field of Classification Search
CPC ..... B41J 11/58; B41J 3/4071; B41J 13/0054; B41J 13/103; B41J 13/106; B41J 13/12; B41J 13/24; B41J 15/00; B41J 15/04; B41J 15/18; B41J 17/02; B41J 17/20; B41J 17/18
See application file for complete search history.

(56) References Cited

FOREIGN PATENT DOCUMENTS

JP 2006-044278 A 2/2006

*Primary Examiner* — Kristal Feggins
(74) *Attorney, Agent, or Firm* — Canon U.S.A., Inc. IP Division

(57) ABSTRACT

A tray guide for guiding a medium tray holding a disk medium and being inserted includes arm portions, and as the tray guide is moved, the arm portions enter between a shaft of a sheet discharge roller and a spur stay while coming into contact with the shaft and the spur stay to push the spur stay upward with respect to the shaft so that spurs are separated from a roller portion to form a space through which the medium tray is to be conveyed.

9 Claims, 13 Drawing Sheets

RECORDING APPARATUS

BACKGROUND OF THE INVENTION

Field of the Invention

The present disclosure relates to a recording apparatus capable of recording an image on a plate-shaped recording medium held on a medium tray.

Description of the Related Art

There are inkjet recording apparatuses capable of performing recording not only on sheet-shaped recording media but also on plate-shaped recording media such as printable disks. Japanese Patent Application Laid-Open No. 2006-044278 discusses a recording apparatus which includes a mechanism for separating a spur from a sheet discharge roller interlocking with an operation of setting a tray guide for guiding a medium tray which is attached when the recording apparatus performs recording on a plate-shaped recording medium. At this time, if the spur comes into contact with the plate-shaped recording medium, a printing surface of the plate-shaped recording medium can be damaged. In order to prevent the damage, such a recording apparatus includes the mechanism to separate the spur from the sheet discharge roller at the time of performing recording on a plate-shaped recording medium.

Japanese Patent Application Laid-Open No. 2006-044278 discusses an apparatus including an interlocking mechanism for separating a spur from a sheet discharge roller between a spur stay supporting the spur and a platen. The interlocking mechanism is provided outside the width of a region through which a sheet-shaped recording medium is conveyed. For this reason, a space dedicated for separating the spur from the sheet discharge roller, such as a space where the interlocking mechanism is installed and a space where the interlocking mechanism is operated, is needed, and as a result thereof, an apparatus size and costs may be increased. Further, because the spur stay is pushed upward with reference to the position of the platen, the platen needs to have great part accuracy, rigidity, and great attachment accuracy in order to improve the positional accuracy of the sheet discharge roller with respect to the spur stay and a tray guide. As a result thereof, an apparatus size and costs may be increased.

SUMMARY OF THE INVENTION

The present disclosure is directed to a recording apparatus capable of recording images on a surface of a plate-shaped recording medium using a medium tray while realizing both reduction in apparatus size and high-quality image recording.

According to an aspect of the present disclosure, a recording apparatus capable of recording an image on a sheet-shaped first recording medium and a disk-shaped second recording medium held on a medium tray includes a sheet discharge roller including a rotary shaft and a roller portion larger in diameter than the rotary shaft, a spur stay configured to rotatably support a plurality of spurs configured to hold, together with the roller portion, the first recording medium discharged from a recording portion therebetween, and a movable tray guide configured to guide the medium tray being inserted, wherein the tray guide includes an arm portion, and wherein as the tray guide is moved toward the recording portion, the arm portion enters between the rotary shaft and the spur stay, and the spur stay is pushed upward by the arm portion with respect to the rotary shaft.

Further features of the present disclosure will become apparent from the following description of exemplary embodiments with reference to the attached drawings.

DESCRIPTION OF THE EMBODIMENTS

Figure 1:
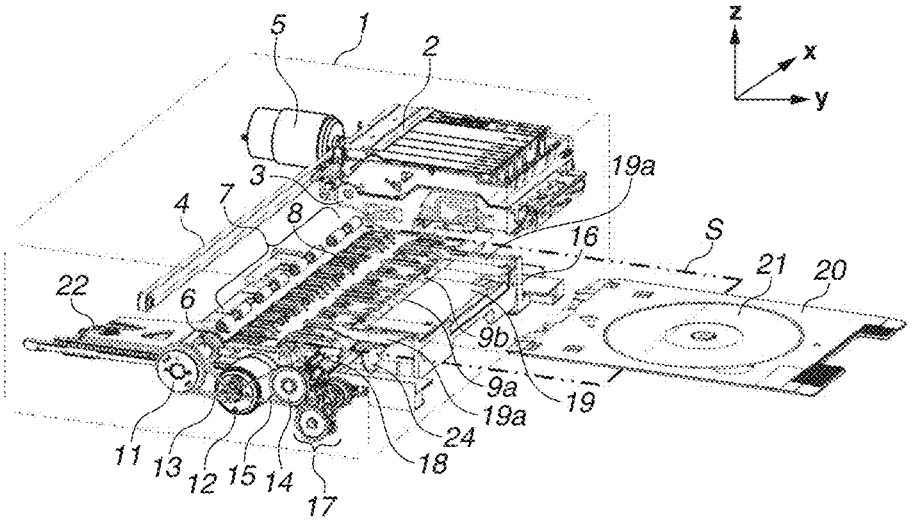
FIG. 1 is a perspective view illustrating a recording apparatus according to a first exemplary embodiment of the present disclosure.

Various exemplary embodiments of the present disclosure will be described below with reference to the drawings. In the present specification and drawings, components having a similar function are given the same reference numerals to omit redundant descriptions.

Figure 2:
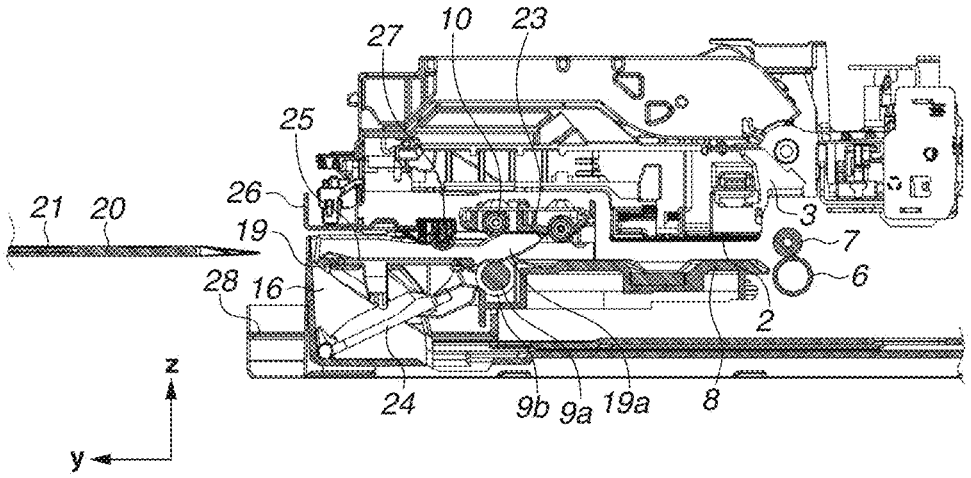
FIG. 2 is a cross-sectional view illustrating the recording apparatus at the time of performing recording on a plate-shaped recording medium.
Figure 3:
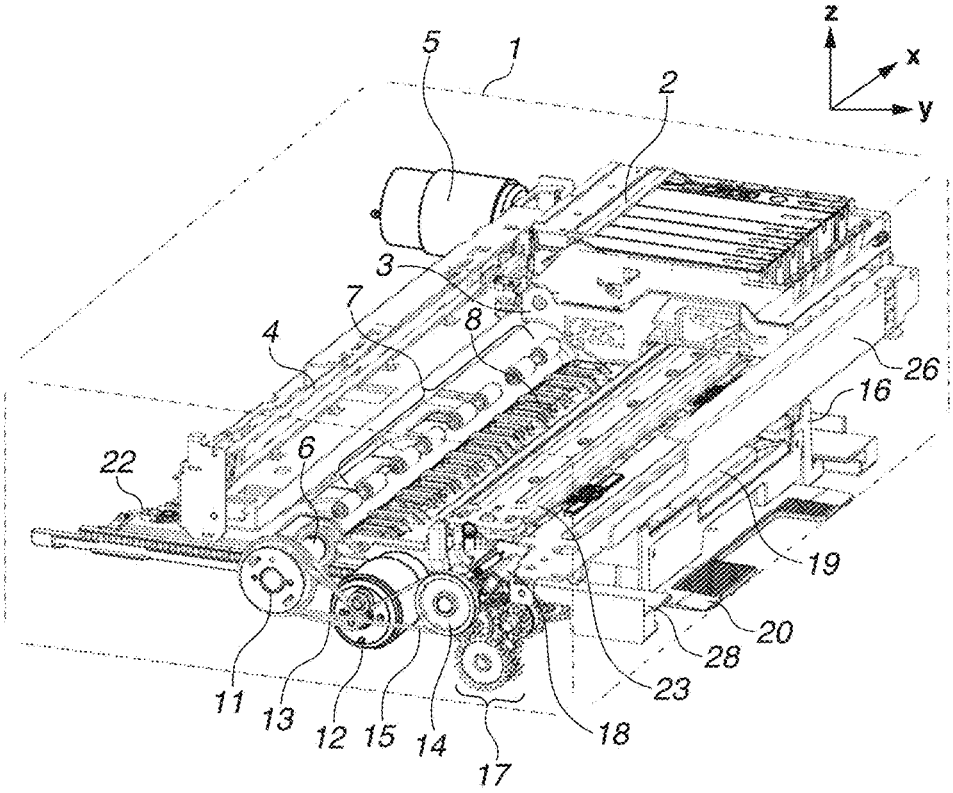
FIG. 3 is a perspective view illustrating the recording apparatus into which a medium tray can be inserted.

FIGS. 1 to 10 each illustrate recording apparatus 1 according to a first exemplary embodiment of the present disclosure. FIG. 1 is a perspective view illustrating an internal configuration of the recording apparatus 1 seen through the housing of the recording apparatus 1. The recording apparatus 1 is an image forming apparatus configured to form images. In the present exemplary embodiment, the recording apparatus 1 is an inkjet printer. The recording apparatus 1 can record (print) an image on a flexible sheet-shaped first recording medium S such as a sheet of paper. The recording apparatus can also record an image on a surface of a second recording medium 21 in the shape of thin plate disk such as a printable disk (compact disk (CD), digital versatile disk (DVD), etc.). FIGS. 1 and 2 each illustrate a state of the recording apparatus 1 at the time of performing recording on the second recording medium 21. FIG. 1 is a perspective view, and FIG. 2 is a cross-sectional view. FIG. 3 illustrates a state in which a medium tray 20 illustrated in FIGS. 1 and 2 is stored near a bottom surface of the recording apparatus 1. Hereinafter, x-, y-, and z-directions specified in FIG. 1 will be referred to as width, depth, and height directions, respectively, of the recording apparatus 1.

The recording apparatus 1 includes in its housing a recording portion including a recording head 2, a carriage 3, a driving belt 4, and a driving motor 5. The inkjet recording head 2 includes a liquid tank for storing liquid such as ink and a discharge opening for discharging liquid. The recording head 2 is placed on the carriage 3. The carriage 3 is supported by a rail (not illustrated) in such a manner that the carriage 3 can reciprocate in a horizontal direction. The carriage is driven and controlled by the driving belt 4 and the driving motor 5 to reciprocate.

Below a region where the recording head 2 reciprocates is provided a conveyance portion including a conveyance roller 6, pinch rollers 7, a platen 8, a sheet discharge roller 9, and spurs 10. A conveyance roller two-step pulley 11 is integrated with one end portion of the conveyance roller 6. A conveyance motor belt 13 for transmitting the driving of a conveyance motor 12 is stretched around the conveyance roller two-step pulley 11 so that the conveyance roller two-step pulley is freely driven to rotate forward and backward. A sheet discharge roller pulley 14 is integrated with one end portion of the sheet discharge roller 9 on the side on which the conveyance roller two-step pulley 11 of the conveyance roller 6 is provided. A sheet discharge roller belt 15 is stretched between the conveyance roller two-step pulley 11 and the sheet discharge roller pulley 14, and the conveyance roller 6 and the sheet discharge roller 9 are driven in synchronization with each other according to the driving force of a driving motor 12. During execution of recording on the first recording medium S, the conveyance roller 6 and the pinch rollers 7 hold the first recording medium S therebetween and convey the first recording medium S to a recording position on the platen 8 where the recording head 2 can perform recording. Then, an image is formed by serial printing in which band recording and step feeding are repeated. Driving in a direction in which the first recording medium S is conveyed from the conveyance roller c toward the sheet discharge roller 9 is referred to as "forward rotation driving".

The sheet discharge roller 9 includes a metal shaft 9*a*, which is a rotary roller shaft portion, and a plurality of roller portions, which are concentric with the metal shaft 9*a* and have a larger diameter than the diameter of the metal shaft 9*a*. The plurality of roller portions 9*b* is wound around the metal shaft 9*a* with predetermined spaces and integrated with the metal shaft 9*a*. The plurality of roller portions 9*b* is made of a material having a higher friction coefficient than that of a surface of the metal shaft 9*a*, such as ethylene propylene diene rubber (EPDM rubber). Outer surfaces of the roller portions 9*b* are brought into contact with the sheet-shaped first recording medium S to convey the first recording medium S. The metal shaft 9*a* is not limited to a metallic shaft and may be a shaft made of a high-rigid material other than metals, such as a ceramic material or resin. The friction coefficient of the roller portions 9*b* is a value at which the first recording medium S is conveyed due to friction generated between the roller portions 9*b* and the first recording medium S as the sheet discharge roller 9 is rotated. Above the sheet discharge roller 9 are provided the plurality of spurs 10, a spur stay 23, and a spur stay spring. The spur stay 23 supports the plurality of spurs 10 in such a manner that each of the plurality of spurs 10 can be separately rotated. The spur stay spring biases the spur stay 23 toward the sheet discharge roller 9. When the recording apparatus 1 performs recording on the sheet-shaped first recording medium S, the spurs 10 and the roller portions 9*b* of the sheet discharge roller 9 hold the first recording medium S therebetween and discharge the recorded first recording medium S. When the recording apparatus 1 performs recording on the plate-shaped second recording medium 21, the spurs 10 are retracted so as not to come into contact with the second recording medium 21.

A user places and fixes the second recording medium 21 shaped like a thin disk on a predetermined position on the medium tray 20 made of hard resin, and inserts the medium tray 20 toward the recording portion in the recording apparatus 1. The medium tray 20 is inserted into a path formed in a tray guide 19 in the recording apparatus 1 and moved in the depth direction of the recording apparatus 1. As the medium tray 20 is moved, the position of the second recording medium 21 relative to the recording head 2 of the recording portion is changed. The tray guide 19 includes two arm portions 19*a* provided on each side of the tray guide 19 in the width direction. A path is formed between the two arm portions 19*a*, and the medium tray 20 on which the second recording medium 21 is placed is moved forward and backward in the depth direction in the path formed between the two arm portions 19*a*. A bottom surface of the tray guide 19 regulates the position of a bottom surface of the medium tray 20 in the height direction, and the two arm portions 19*a* regulate the position of the medium tray 20 in the width direction (x-direction) of the recording apparatus 1. The width of the tray guide 19 and the distance between the two arm portions 19*a* are smaller than the sheet width of the first recording medium S, which has a size largest among the sizes of various sheets that are expected to be used in the recording apparatus 1.

A state of the recording apparatus 1 can be switched between the state in which the first recording medium S is discharged using the spurs 10 and the state in which the spurs 10 are retracted so as not to come into contact with the second recording medium 21, by changing the positions of the arm portions 19*a* to change the positions of the spurs 10. FIGS. 1 and 2 illustrate the state in which the spurs 10 are pushed upward and retracted. The arm portions 19*a* are each connected to one end of a sheet discharge tray 16, and the positions of the arm portions 19*a* are changed as the sheet discharge tray 16 is moved forward and backward in the depth direction of the recording apparatus 1. When the sheet discharge tray 16 is inserted in the depth direction of the recording apparatus 1 by the user, the arm portions 19*a* enter a space between the metal shaft 9*a* of the sheet discharge roller 9 and the spur stay 23 while coming into contact with the metal shaft 9*a* and the spur stay 23, and the spur stay 23 is pushed upward with respect to an outer peripheral surface (vertex) of the metal shaft 9*a*. In this state, the sheet discharge roller 9 and the spurs 10 are separated to form a space between the sheet discharge roller 9 and the spurs 10, and the medium tray 20 can pass through the space. In order to realize the formation of the space, each portion of the arm portions 19*a* that comes into contact with the metal shaft 9*a* when the spur stay 23 is pushed upward has a thickness (dimension) greater than the thickness of the medium tray 20 in the height direction.

Figure 4:
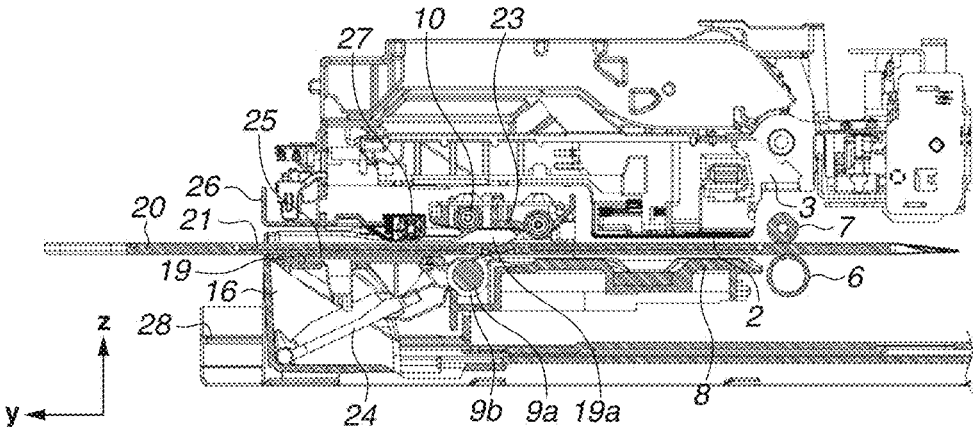
FIG. 4 is a cross-sectional view illustrating the recording apparatus in which the medium tray is inserted.

FIG. 4 illustrates the state of the recording apparatus 1 at the time of performing recording on the second recording medium 21. After the path through which the medium tray 20 with the second recording medium 21 placed thereon is to be inserted is formed, the medium tray 20 can be inserted into the recording apparatus 1 along the path as illustrated in FIG. 4. In this state, the spur stay 23 is pushed upward by the arm portions 19*a* at respective end portions in the width direction (x-direction) so that the spurs 10 do not come into contact with the second recording medium 21. The second recording medium 21 is placed on the medium tray 20 and moved forward and backward in the depth direction of the recording apparatus 1 to change the position of the second recording medium 21 relative to the recording head 2. The forward/backward movement and the recording by the recording head 2 are repeated to record an image on the second recording medium 21.

Figure 5:
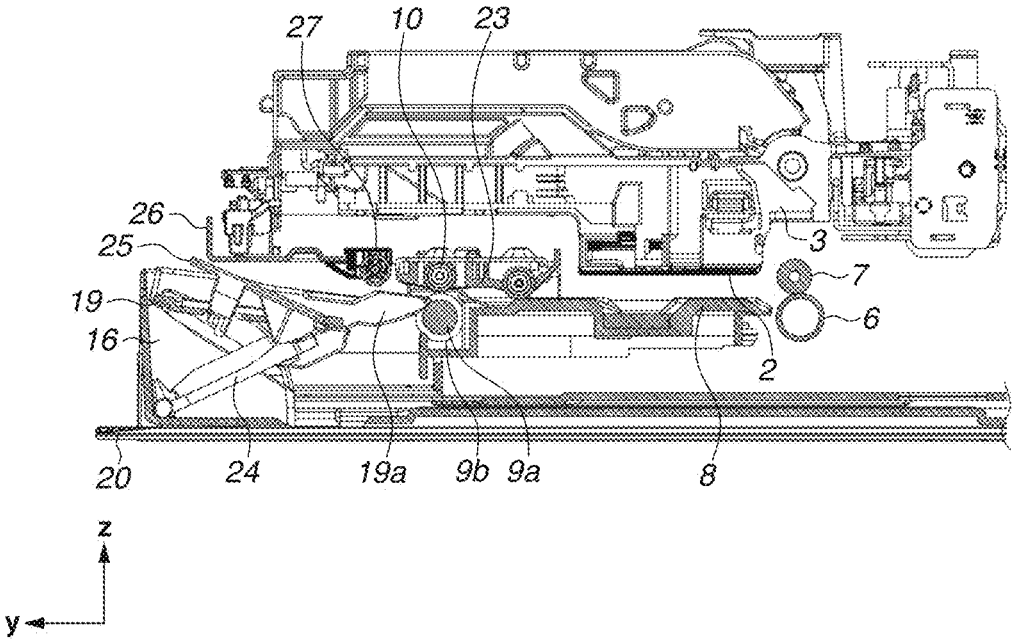
FIG. 5 is a cross-sectional view illustrating the recording apparatus with a medium tray stored therein.
Figure 6:
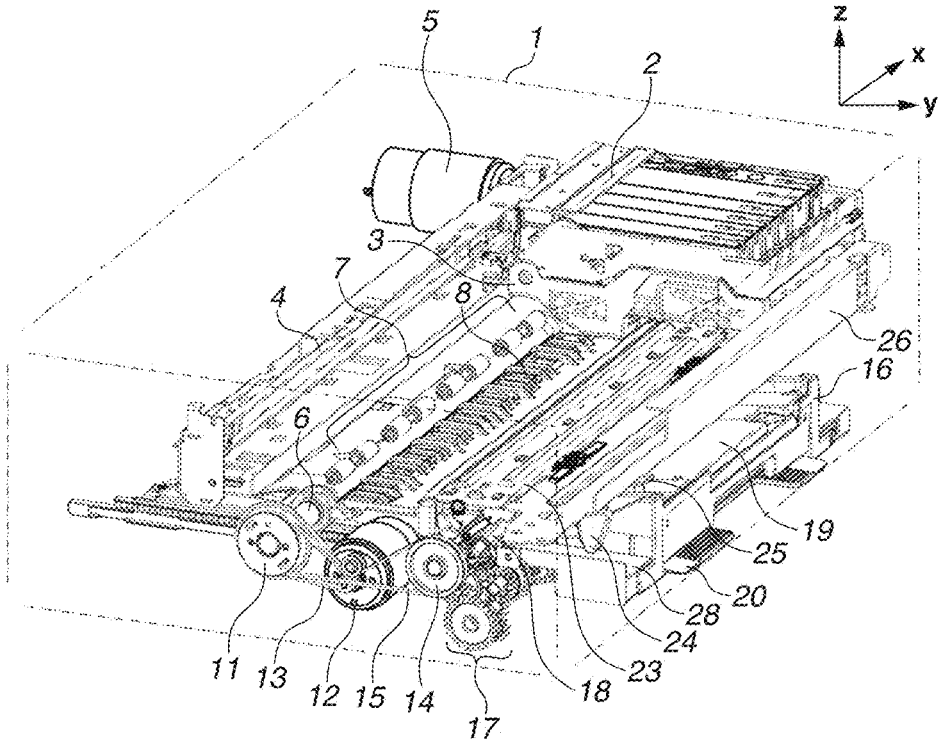
FIG. 6 is a perspective view illustrating the recording apparatus with the medium tray stored therein.

FIG. 5 illustrates the recording apparatus 1 with the medium tray 20 stored therein. FIG. 6 is a perspective view illustrating the recording apparatus 1 with the medium tray 20 stored therein. The medium tray 20 can be stored in the recording apparatus 1 when recording is not performed on the second recording medium 21. The medium tray 20 can be stored near the bottom surface of a main body. The sheet discharge tray 16 is pulled frontward (in a positive direction of y-axis) in the depth direction of the recording apparatus 1 while the medium tray 20 is stored, compared to the state in which the medium tray 20 is inserted, and the arm portions 19*a* are located apart from the spur stay 23. In this state, a lock lever 22 illustrated in FIG. 1 is in contact with a cam portion of a bottom frame (not illustrated) so that the lock lever 22 is not moved backward any further unless the lock biased by a biasing spring (not illustrated) is cleared. When a force greater than the force biased by the lock lever 22 is applied, the sheet discharge tray 16 is inserted in the depth direction to reach the state illustrated in FIG. 3. The recording apparatus 1 includes a medium tray stopper 25 to prevent the medium tray 20 from being inserted into the recording apparatus 1 when the arm portions 19*a* are not present between the spur stay 23 and the metal shaft 9*a*. The medium tray stopper 25 is a member for preventing entry of the medium tray 20. The medium tray stopper 25 is positioned and held in such a manner that a space between the medium tray stopper 25 and a front stay 26 into which the medium tray 20 is inserted becomes small when the arm portions 19*a* are located apart from the spur stay 23. The size of the space is desirably small enough not to allow the medium tray 20 to be inserted into the space.

The recording apparatus 1 can perform recording on the sheet-shaped first recording medium S even when the medium tray 20 is stored in the recording apparatus 1, and the recorded first recording medium S is conveyed above the tray guide 19 and the medium tray stopper 25 and then discharged out of the recording apparatus 1.

Figure 7:
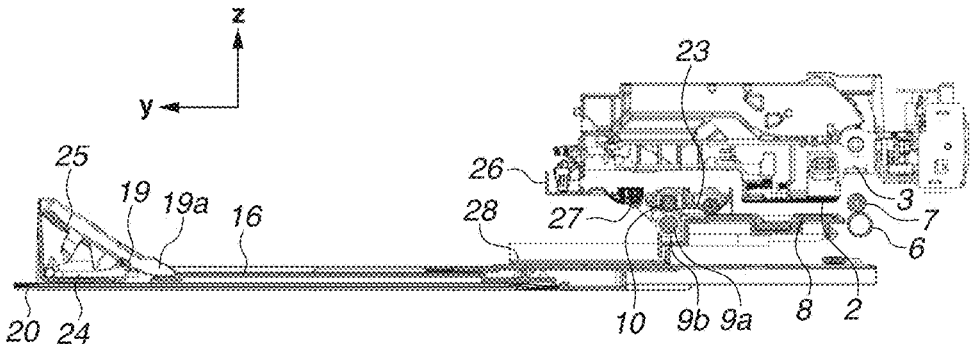
FIG. 7 is a cross-sectional view illustrating the recording apparatus with a sheet discharge tray extended therefrom.
Figure 8:
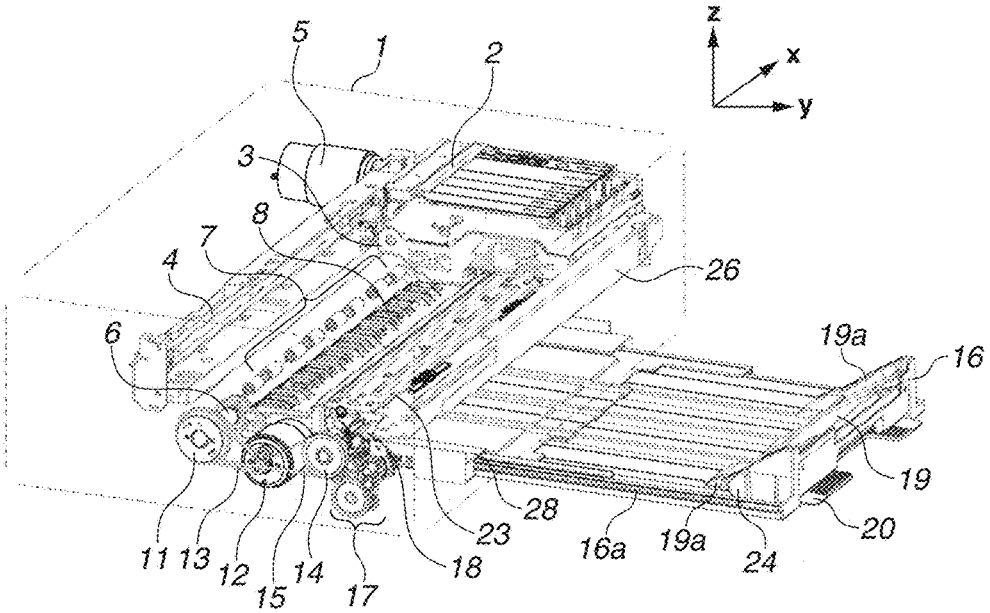
FIG. 8 is a perspective view illustrating the recording apparatus with the sheet discharge tray extended therefrom.
Figure 9:
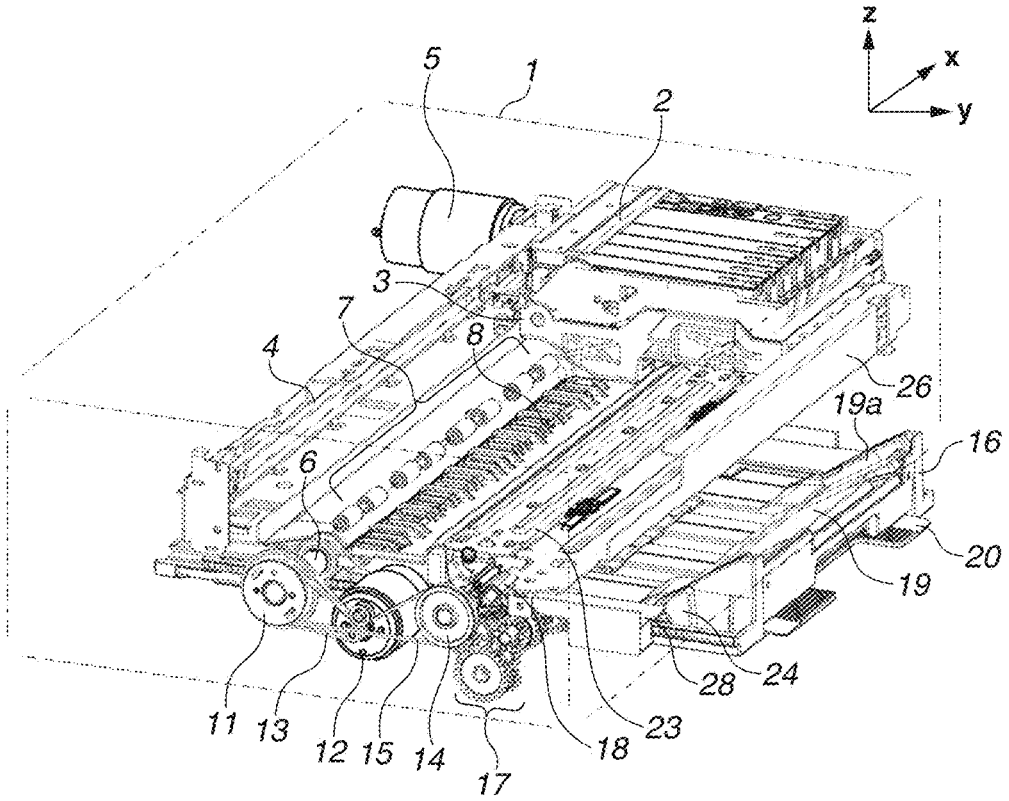
FIG. 9 illustrates a movement of the sheet discharge tray.

Besides the state illustrated in FIGS. 1 to 4 in which the recording apparatus 1 performs recording on the second recording medium 21 and the state illustrated in FIGS. 5 and 6 in which the medium tray 20 is stored, the recording apparatus 1 can be in a state in which the sheet discharge tray 16 configured to receive the recorded first recording medium S is pulled out and extended. FIGS. 7 and 8 each illustrate the recording apparatus 1 with the sheet discharge tray 17 extended therefrom. When the sheet discharge tray 17 is extended, the recorded first recording medium S held between and discharged by the sheet discharge roller 9 and the spurs 10 is placed on the sheet discharge tray 16. A leading edge of the sheet discharge tray 16 includes a raised portion that is raised so as to slope toward the inside of the sheet discharge tray 16. The sheet discharge tray 16 is provided with the tray guide 19, and when the sheet discharge tray 17 is extended, the tray guide 19 lying down due to the weight of the tray guide 19 forms the raised portion together with the sheet discharge tray 16. The raised portion is included so that the discharged first recording medium S is more reliably placed on the sheet discharge tray 16 and the raised portion supports the discharged first recording medium S in an inclined state.

The tray guide 19 is supported swingably around the edge portion of the sheet discharge tray 16. When the sheet discharge tray 16 in the extended state is pushed to a position illustrated in FIG. 9 so as to be inserted into the main body of the recording apparatus 1 in the depth direction of the recording apparatus 1, a bottom frame 28 comes into contact with a protruded portion of a link lever 24 provided on the raised portion to elevate the link lever 24. When the link lever 24 is elevated to the state illustrated in FIG. 10, the tray guide 19 and the medium tray stopper 25 are pushed by the link lever 24 and swung and elevated so that the medium tray 20 is stored and the arm portions 19*a* are in contact with the metal shaft 9*a* (FIGS. 5 and 6).

If the sheet discharge tray 16 is further pushed against the locking force biased by the lock lever 22 while the medium tray 20 is stored, the arm portions 19*a* are further pushed upward while being in contact with the metal shaft 9*a*. The arm portions 19*a* come into contact with the spur stay 23 and enter a space between the spur stay 23 and the metal shaft 9*a*. At this time, the arm portions 19*a* push the spur stay 23 upward, enter the space between the spur stay 23 and the metal shaft 9*a*, and are held while being in contact with the spur stay 23 and the metal shaft 9*a*, and all the spurs 10 are separated from the roller portions 9*b* of the sheet discharge roller 9. In this state, the medium tray 20 can be inserted into the recording apparatus 1, and printing can be performed on the second recording medium 21 placed on the medium tray 20.

To print on the second recording medium 21, the user inserts the medium tray 20 with the second recording medium 21 placed thereon onto the tray guide 19 and then pushes the medium tray 20 to a predetermined position. At this time, a leading edge of the medium tray 20 is located just before the conveyance roller 6. Then, when the user gives an instruction to start printing using an operation unit, the medium tray 20 is biased by a medium tray pressing roller 27 and pulled by backward rotation of the sheet discharge roller 9 and the conveyance roller 6, and a front edge of the second recording medium 21 is consequently located immediately below the recording head 2. Thereafter, band printing by the recording head 2 and conveying of the medium tray 20 are repeated to record an image on the second recording medium 21. A back edge of the medium tray 20 includes a depressed portion, and when the medium tray pressing roller 27 is engaged with the depressed portion, the medium tray 20 is stopped away from the sheet discharge roller 9 with the back edge of the medium tray 20 slightly elevated and bent. The user can remove the stopped medium tray 20 to remove from the medium tray 20 the second recording medium 21 on which the image is recorded. During the recording on the second recording medium 21, all the spurs 10 are separated from the sheet discharge roller 9 to prevent damage to the surface of the second recording medium 21. Thereafter, when the sheet discharge tray 16 is pulled frontward, the spur stay 23 is lowered, and the recording apparatus 1 can be changed again to the stored state in which the medium tray 20 is stored or the extended state in which the sheet discharge tray 16 is extended.

Figure 10:
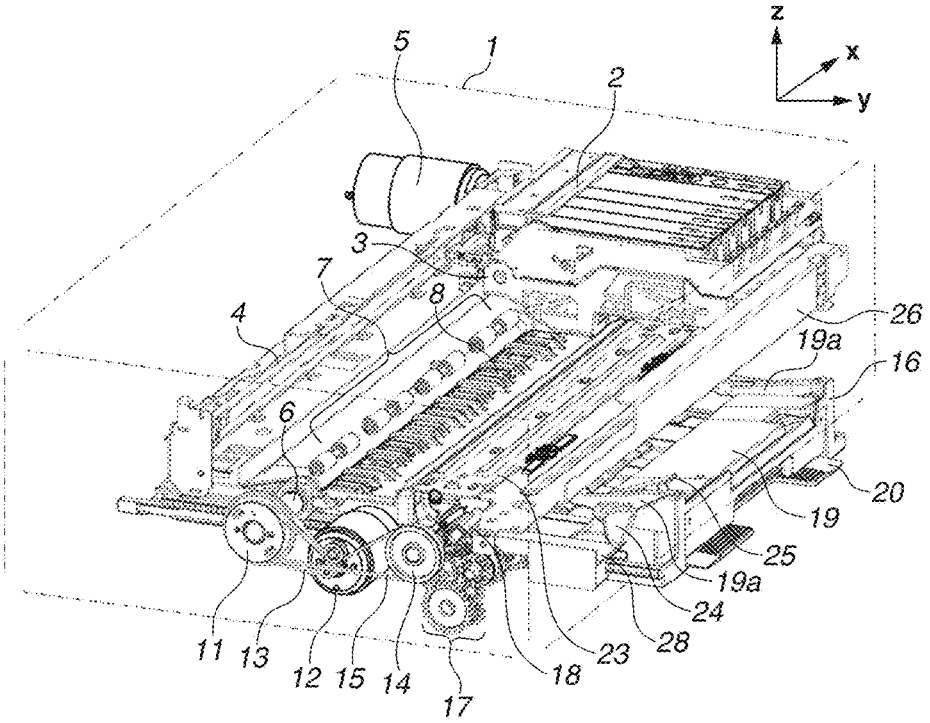
FIG. 10 illustrates a movement of the sheet discharge tray.

Back to FIG. 10, a driving rack portion 16*a* is provided on one end portion of the sheet discharge tray 16. The driving rack portion 16*a* is constantly connected to a tray driving gear train 17. The tray driving gear train 17 is rotated, interlocking with forward/backward movement of the sheet discharge tray 16. To one end portion of the sheet discharge roller 9 is provided a driving connection trigger portion 18 capable of connecting and disconnecting the driving of the sheet discharge roller 9 to and from the tray driving gear train 17. The sheet discharge roller performs predetermined or more backward rotations and the carriage 3 is moved to an endmost portion, whereby the driving connection trigger portion 18 connects the driving. When the sheet discharge roller 9 is rotated forward, the sheet discharge tray 16 is extended and moved forward. When the sheet discharge roller 9 is rotated backward, the sheet discharge tray 16 is retracted and moved backward. A detection unit (not illustrated) can be used to detect the position of the sheet discharge tray 16 so that the sheet discharge tray 16 can be moved to a predetermined position. When the carriage 3 is retracted from the endmost portion, the connection is cancelled. While the driving is not connected, the sheet discharge tray 16 can be moved by a user operation, and the position of the sheet discharge tray 16 can be detected by the detection unit (not illustrated).

As described above, in the present exemplary embodiment, the spur stay 23 is pushed upward using not the platen 8 as in conventional techniques but the metal shaft 9*a*, which is a shaft portion of the sheet discharge roller 9, as a direct positional reference. This enables more accurate dimension management of the space between the spur stay 23 and the medium tray 20 to prevent the medium tray 20 and the second recording medium 21 held and fixed onto the medium tray 20 from coming into contact with a portion of the plurality of spurs 10. Further, the positional relationship between the tray guide 19 and the medium tray 20 is also managed with great accuracy. This enables high-quality image recording on the second recording medium 21. In other words, the platen 8 does not need great part accuracy, rigidity, and great attachment accuracy, so reduction in apparatus size and cost and high-quality image recording are both realized.

Further, in the present exemplary embodiment, the tray guide 19 includes the two arm portions 19*a* provided on each side in the width direction, and the path through which the medium tray 20 is to be moved is formed between the two arm portions 19*a*. The distance between the two arm portions 19*a* is smaller than the sheet width of the first recording medium S, which has the size largest among the sizes that are expected to be used. Specifically, the two arm portions 19*a* are located inside the width of a sheet passing region. This arrangement is realized by the configuration in which the two arm portions 19*a* are in contact with not the roller portion 9*b* of the sheet discharge roller 9 but the metal shaft 9*a*. This realizes both the reduction in apparatus size and cost and the high-quality image recording.

FIGS. 11A, 11B, 12A, and 12B each illustrate the configuration of a recording apparatus 2 according to a second exemplary embodiment of the present disclosure. The recording apparatus 2 includes a tray guide 219 in place of the tray guide 19 of the recording apparatus 1, and a sheet discharge tray front portion 216*a* and a sheet discharge tray back portion 216*b* in place of the sheet discharge tray 16. Differences from the recording apparatus 1 will be mainly described below.

The sheet discharge tray is a two-stage sheet discharge tray that can be moved forward and backward by sliding. The tray guide 219 includes tray guide arms 219*a*, a tray guide base front portion 219*b*, and a tray guide base back portion 219*c*. The tray guide base front portion 219*b* and the tray guide arms 219*a* are each swingably connected to the sheet discharge tray back portion 216*b* to form two four-link mechanisms.

Figure 11A:
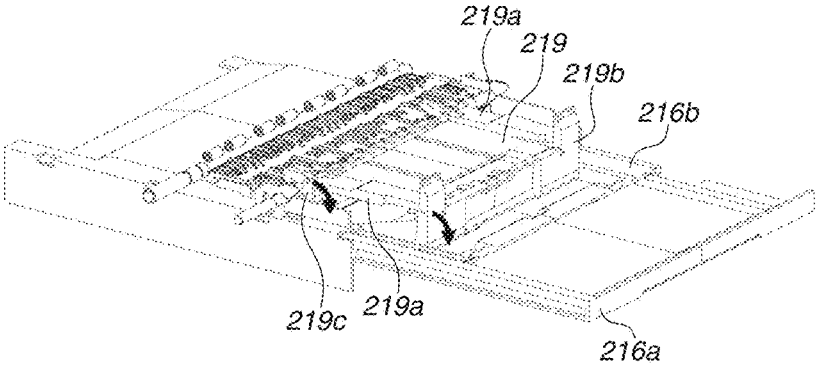
FIGS. 11A and 11B are perspective views each schematically illustrating a recording apparatus according to a second exemplary embodiment of the present disclosure.
Figure 12A:
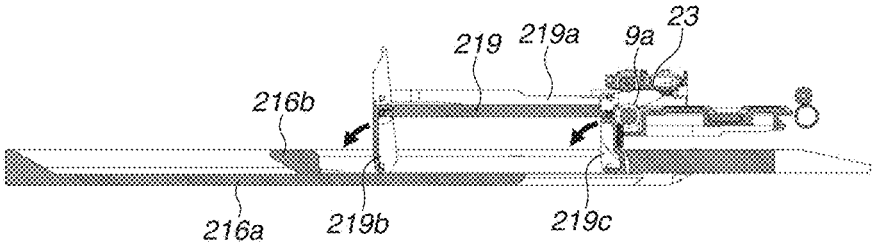
FIGS. 12A and 12B are cross-sectional views each schematically illustrating the recording apparatus.

FIGS. 11A and 12A each illustrate a state in which printing is performed on the second recording medium 21. When the medium tray 20 is moved forward and backward, the tray guide 219 regulates the position of the bottom surface of the medium tray 20, and the tray guide arms 219*a* regulate the positions of the both ends of the medium tray to guide the medium tray 20 to a portion below the recording head 2. When the sheet discharge tray front portion 216*a* is pulled outward and a front edge of the tray guide base front portion 219*b* is pulled upward, the tray guide arm 219*a* enters a space between the metal shaft 9*a* and the spur stay 23. Consequently, wedge-shaped cam surfaces of the tray guide arms 219*a* push the spur stay 23 upward to separate the spur stay 23 from the metal shaft 9*a* of the sheet discharge roller 9. During the printing using the medium tray 20, the tray guide 219 is in direct contact with the metal shaft 9*a* of the sheet discharge roller 9 without parts such as the platen 8 therebetween to improve accuracy in height of the tray guide 219 and the spur stay 23 with respect to the sheet discharge roller 9.

Figure 11B:
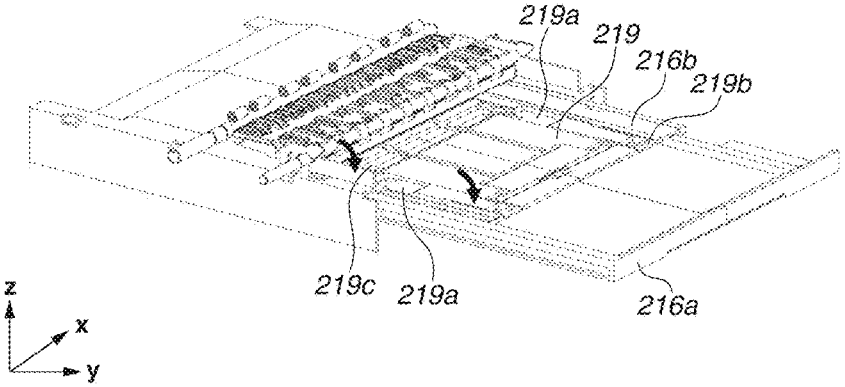
Figure 12B:
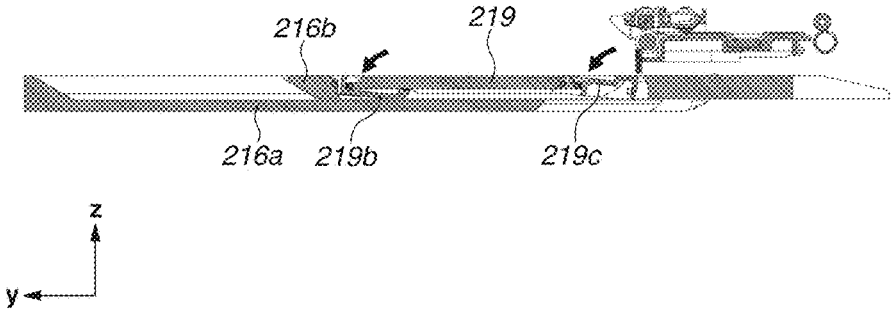

When the printing on the second recording medium 21 is ended, if a leading edge of the tray guide base front portion 219*b* is pulled frontward, the tray guide arm 219*a* is moved from the space between the metal shaft 9*a* and the spur stay 23, and the spur stay 23 is lowered, as illustrated in FIGS. 11B and 12B. At this time, the tray guide arms 219*a*, the tray guide base front portion 219*b*, and the tray guide base back portion 219*c* are retracted substantially in parallel to form a surface on which the first recording medium S is to be placed. The medium tray can be stored into main body of the recording apparatus 2 by moving the sheet discharge tray front portion 216*a* backward while the tray guide 219 is retracted.

In the present exemplary embodiment, recording on the second recording medium 21 can be performed with the sheet discharge tray being extended so that the sheet discharge tray can form a reception surface to receive the medium tray 20 to be ejected.

Figure 13A:
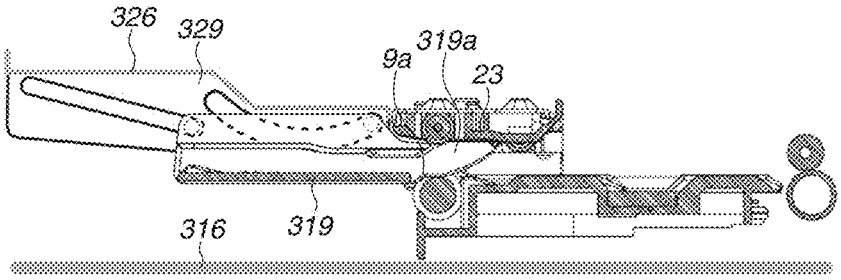
FIGS. 13A and 13B are cross-sectional views each schematically illustrating a recording apparatus according to a third exemplary embodiment of the present disclosure.
Figure 13B:
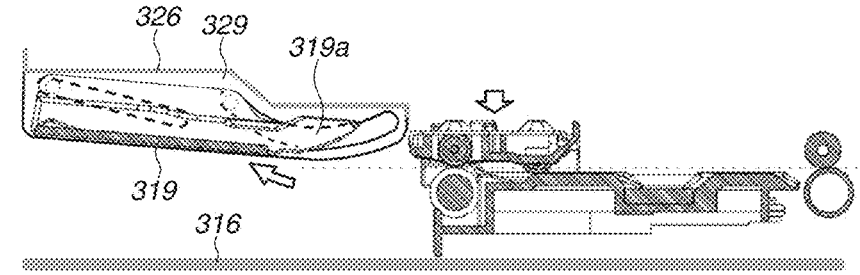
Figure 13B:
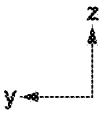

FIGS. 13A and 13B each illustrate the configuration of a recording apparatus 3 according to a third exemplary embodiment of the present disclosure. As in the recording apparatuses 1 and 2, the recording apparatus 3 can perform recording not only on the sheet shaped first recording medium S but also on the plate-shaped second recording medium 21.

The recording apparatus 3 includes a tray guide 319 in place of the tray guide 19 of the recording apparatus 1. The tray guide 319 includes two arms 319*a* provided on each end of the tray guide 319 in the width direction. The tray guide 319 is held by a guide the rail 329 fixed to a front stay 326 and can be moved forward and backward. In the state illustrated in FIG. 13A in which recording is performed on the second recording medium 21, the arms 319*a* enters a space between the metal shaft 9*a* of the sheet discharge roller 9 and the spur stay 23, as in the first exemplary embodiment. Consequently, the spur stay 23 is separated from the sheet discharge roller 9.

When the tray guide 319 in the state illustrated in FIG. 13A is pulled frontward, the arms 319*a* of the tray guide 319 are removed from the space between the metal shaft 9*a* and the spur stay 23 and separated from the spur stay 23. The spur stay 23 is lowered so that recording is to be performed on the first recording medium S. The tray guide 319 can be retracted, while changing its orientation, into a space above a region where the first recording medium S is discharged. In the present exemplary embodiment, the tray guide 319 and the sheet discharge tray are separately operated, so no complicated link mechanism is needed to achieve cost reduction. Further, the operation procedure is simplified to improve operability.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-150117, filed Jul. 29, 2016, which is hereby incorporated by reference herein in its entirety.

What is claimed is:

1. A recording apparatus comprising:

a recording portion capable of recording an image on a sheet-shaped first recording medium and a disk-shaped recording medium placed on a medium tray;

a sheet discharge roller including a rotary shaft and a roller portion larger in diameter than the rotary shaft;

a spur holder configured to rotatably hold a plurality of spurs configured to convey, together with the roller portion, the first recording medium recorded by the recording portion therebetween;

a discharge tray on which sheets of the first recording medium discharged by the sheet discharge roller are to be stacked;

a tray driving unit configured to rotate and move the discharge tray, wherein the tray driving unit causes the discharge tray to move to a first position, which is a position of being stored in the apparatus, and a second position, at which the first recording medium is able to be stacked; and an arm portion provided on the discharge tray, wherein, when the discharge tray moves to a third position that is opposite of the second position with respect to the first position, the arm portion enters between the rotary shaft and the spur holder, and the entry of the arm portion causes the plurality of spurs to become separated from the roller portion.

2. The recording apparatus according to claim 1, wherein a portion of the arm portion that comes into contact with the rotary shaft when the spur holder is pushed upward is thicker than the medium tray in a height direction, and wherein when the spur holder is pushed upward, the plurality of spurs is separated from the roller portion to form a space through which the medium tray is to be conveyed.

3. The recording apparatus according to claim 1, wherein the arm portion is provided on each of two sides of the tray guide in a width direction, and a path through which the medium tray is to be moved is formed between the two arm portions.

4. The recording apparatus according to claim 3, wherein a distance between the two arm portions in the width direction is smaller than a sheet width of the first recording medium having a size largest among sizes that are expected to be used.

5. The recording apparatus according to claim 1, wherein the tray guide is provided on a sheet discharge tray on which the first recording medium discharged from the recording portion is to be placed, and the tray guide is moved, interlocking with a movement of the sheet discharge tray.

6. The recording apparatus according to claim 5, wherein the tray guide is swingably supported with respect to the sheet discharge tray.

7. The recording apparatus according to claim 1, further comprising a member configured to prevent entry of the medium tray into a path on the tray guide when the arm portion is located not in the space between the rotary shaft and the spur holder but apart from the space.

8. The recording apparatus according to claim 1, wherein the rotary shaft is made of metal, and the roller portion is made of a material having a higher friction coefficient than a friction coefficient of a surface of the rotary shaft.

9. The recording apparatus according to claim 1, wherein the recording portion records an image on the first recording medium and the second recording medium using an inkjet method.

* * * * *